US011056834B2

(12) United States Patent
Casher et al.

(10) Patent No.: US 11,056,834 B2
(45) Date of Patent: Jul. 6, 2021

(54) ELECTRICIAL CONNECTOR WITH STRUCTURE FOR REDUCING RESONANCES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Patrick R. Casher, North Aurora, IL (US); Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/834,370

(22) Filed: Mar. 30, 2020

(65) Prior Publication Data

US 2020/0313358 A1 Oct. 1, 2020

Related U.S. Application Data

(60) Provisional application No. 62/826,991, filed on Mar. 30, 2019.

(51) Int. Cl.
*H01R 13/6471* (2011.01)
*H01R 12/72* (2011.01)
(Continued)

(52) U.S. Cl.
CPC ..... *H01R 13/6471* (2013.01); *H01R 12/721* (2013.01); *H01R 13/2442* (2013.01);
(Continued)

(58) Field of Classification Search
CPC ..... H01R 13/6471; H01R 13/2442; H01R 13/41; H01R 13/514; H01R 13/6588;
(Continued)

(56) References Cited

U.S. PATENT DOCUMENTS 6,341,965 B1 1/2002 Starlink
6,447,317 B1 * 9/2002 Billman ..... H01R 13/6582 439/260
(Continued)

FOREIGN PATENT DOCUMENTS

CN 1187058 A 7/1998
CN 205194974 U 4/2016
(Continued)

*Primary Examiner* — Abdullah A Riyami
*Assistant Examiner* — Marcus E Harcum
(74) *Attorney, Agent, or Firm* — Ming Chieh Chang; Wei Te Chung

(57) ABSTRACT

An electrical connector includes a housing, a plurality of contacts located in each wall of the housing and having grounding contacts and differential-pair contacts, and a grounding bar. The grounding bar includes a pair of lower spring fingers respectively contacting lower regions of the ground contacts in a transverse direction, and a pair of upper spring fingers respectively contacting upper regions of the ground contacts in the transverse direction, an upper transverse bar linked between the pair of upper spring fingers along a longitudinal direction, a lower transverse bar linked between the pair of lower spring fingers along the longitudinal direction, the pair of upper spring fingers extend upwardly from the lower transverse bar and a transverse base having retaining device attached to a lower portion of the housing. The pair of lower spring fingers upwardly extend from the transverse base.

17 Claims, 11 Drawing Sheets

(51) Int. Cl.
*H01R 13/24* (2006.01)
*H01R 13/41* (2006.01)
*H01R 13/514* (2006.01)
*H01R 13/6588* (2011.01)

(52) U.S. Cl.
CPC ..... *H01R 13/41* (2013.01); *H01R 13/514* (2013.01); *H01R 13/6588* (2013.01)

(58) Field of Classification Search
CPC ..... H01R 13/6461; H01R 13/6582; H01R 13/65914; H01R 13/6594; H01R 13/6597; H01R 13/721; H01R 13/724; H01R 13/725; H01R 13/737
USPC ..... 439/636, 101, 104, 108
See application file for complete search history.

(56) References Cited

U.S. PATENT DOCUMENTS 8,142,207 B1 * 3/2012 Ljubijankic ..... H01R 13/6473 439/95
9,281,589 B2 * 3/2016 Hsiao ..... H01R 4/04
10,574,002 B1 * 2/2020 Henry ..... H01R 13/6587
10,749,289 B2 * 8/2020 Long ..... H01R 13/6461
2012/0064743 A1 * 3/2012 Qin ..... H01R 13/6471 439/92
2013/0288513 A1 * 10/2013 Masubuchi ..... H01R 12/775 439/386
2016/0006182 A1 * 1/2016 Patel ..... H01R 13/6597 439/108
2017/0018880 A1 * 1/2017 Phillips ..... H01R 12/727
2018/0034216 A1 * 2/2018 Zhong ..... H01R 13/6471
2018/0090887 A1 * 3/2018 Little ..... H01R 13/6594
2018/0166812 A1 * 6/2018 Lin ..... H01R 12/721
2018/0294592 A1 * 10/2018 Huang ..... H01R 12/721
2018/0323526 A1 11/2018 Ueyama
2019/0052019 A1 * 2/2019 Huang ..... H01R 13/6476
2019/0131743 A1 * 5/2019 Hsu ..... H01R 13/405
2019/0214755 A1 * 7/2019 Manickam ..... H01R 12/721
2020/0099149 A1 * 3/2020 Xu ..... H01R 12/716
2020/0212632 A1 * 7/2020 Liong ..... H01R 12/716

FOREIGN PATENT DOCUMENTS

CN 205335540 U 6/2016
CN 108649366 A 10/2018
CN 109004400 A 12/2018
CN 109193203 A 1/2019
CN 208385670 U 1/2019
CN 109301546 A 2/2019
CN 109546388 A 3/2019
WO WO2016003663 A1 1/2016

* cited by examiner

ELECTRICIAL CONNECTOR WITH STRUCTURE FOR REDUCING RESONANCES

CROSS REFERENCE TO RELATED APPLICATIONS

This application claims the benefit of, and priority to, U.S. Provisional Patent Application No. 62/826,991, filed Mar. 30, 2019, the contents of which are incorporated entirely herein by reference.

BACKGROUND OF THE INVENTION

1. Field of the Invention

The present invention relates generally to an electrical connector, and more particularly to the electrical connector having a structure reducing resonances in the connector, especially when the higher frequencies the contacts experience.

2. Description of Related Arts

Resonances related to the ground conductor structures in connectors are a common issue for connector designers. These resonances are typically recognized in the insertion loss and cross talk, S-Parameter, performance of connectors. Standard's requirements and customer's expectations are that the performance of connectors has no resonances within the connector application's bandwidth. For applications utilizing NRZ signaling this bandwidth is at least up to ½ the data rate in terms of frequency and for applications utilizing PAM4 signaling this would be at least up to ¼ of the data rate. Consequently, as data rates increase the resonances have to be addressed to increasing frequencies. Addressing this becomes more challenging at higher frequencies. Current known methods for improving resonance performance in connectors are based on either pushing resonances out higher in frequency and/or dampening resonances. The former is to periodically interconnect the ground terminals within the connector. The latter is to dampen the resonances with the connector wherein one know method is to use the conductive "loose" plastic which is essentially uneconomic, and another known method is to adjust the ratio of air between the adjacent two signal terminals relative to that between the signal terminal and the ground terminal, or the ratio of separation applied thereto as well.

An electrical connector having economic structure to overcome resonances is desired.

SUMMARY OF THE INVENTION

An object of the invention is to provide an electrical connector comprises an insulative housing comprising two opposite elongate walls and an elongate slot between the two elongate walls, a plurality of contacts located in each elongate wall of the housing and having grounding contacts and differential-pair contacts, a unitary grounding bar attached to each elongate wall of the housing. The grounding bar comprises a pair of lower spring fingers respectively contacting lower regions of the ground contacts in a transverse direction, and a pair of upper spring fingers respectively contacting upper regions of the ground contacts in the transverse direction an upper transverse bar linked between the pair of upper spring fingers along a longitudinal direction, a lower transverse bar linked between the pair of lower spring fingers along the longitudinal direction. The pair of upper spring fingers extend upwardly from the lower transverse bar. A transverse base has retaining device attached to a lower portion of the housing, and the pair of lower spring fingers upwardly extend from the transverse base.

DETAILED DESCRIPTION OF THE PREFERRED EMBODIMENT

Figure 1:
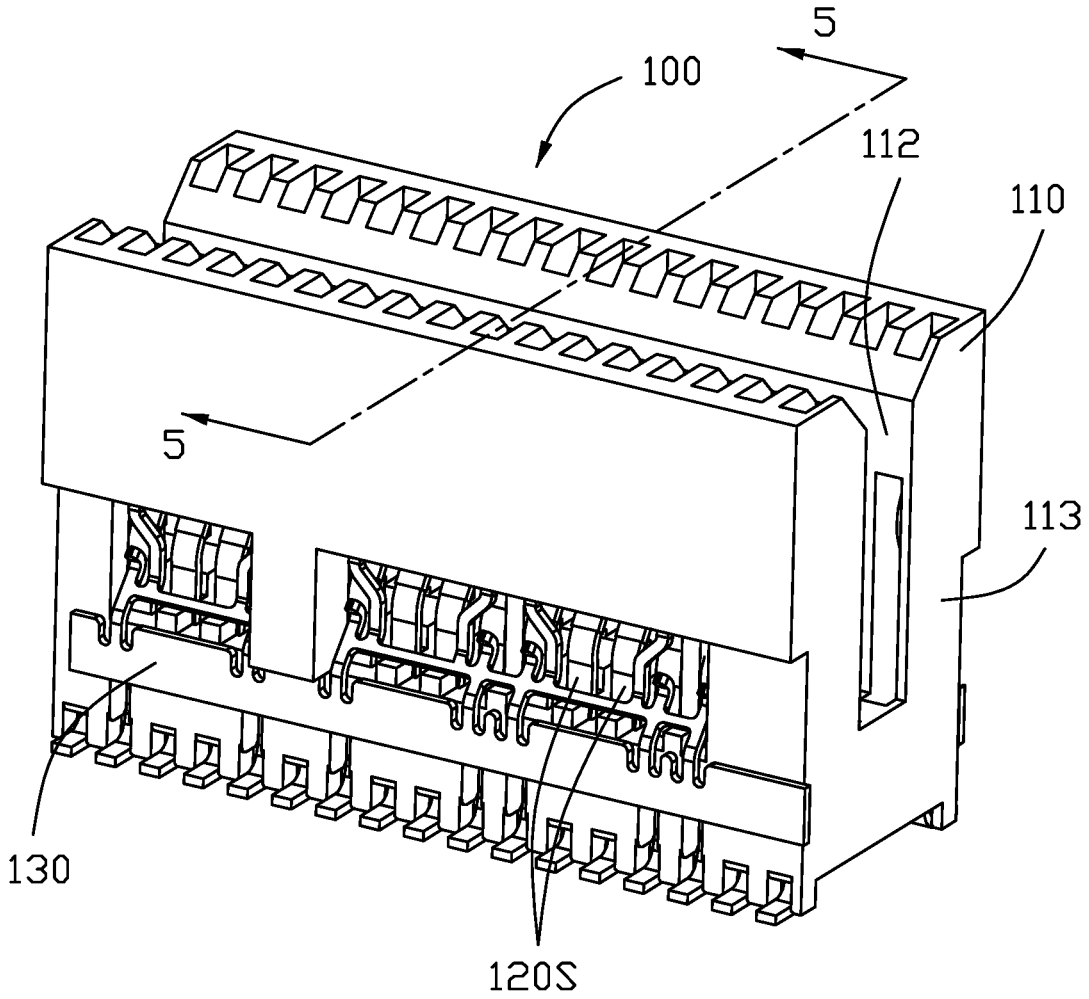
FIG. 1 is a perspective view of an electrical connector according to a preferred embodiment of the present invention.

Referring to FIGS. 1-9 showing an electrical connector 100, which can be a PCI Express card edge connector and only a part is shown in the these figures, the electrical connector 100 includes an elongate insulative housing 110 with two opposite elongate walls 113 and two rows of conductive contacts 120 retained in the corresponding passageways 111 of the housing 110, the passageways 111 are located at the elongate walls 113. A receiving slot 112 is formed in the housing 110 along a longitudinal direction and between the two elongate walls 113 and upwardly exposed to an exterior in a vertical direction perpendicular to the longitudinal direction. The two rows of contacts 120 are opposite to each other in a transverse direction perpendicular to both the longitudinal direction and the vertical direction. Each of the contact 120 includes an upper resilient section 122 extending into the receiving slot 112 for contacting a card module (not shown) received within the receiving slot 112, a lower tail section 124 soldered upon a printed circuit board (not shown) on which the housing 110 is seated, and a middle retaining section 126 therebetween in the vertical direction.

The contacts 120 include differential pair signal contacts 120S and ground contacts 120G/120*g* arranged with each other along the longitudinal direction. As a result, the contacts 120 may be grouped to have each group include a pair of differential-pair signal contacts 120S sandwiched between a pair of first ground contacts 120G therebetween and other/second grounding contacts 120*g* as clearly shown in FIG. 4(A)-4(B), wherein in this embodiment only one other grounding contact 120*g* in each row of contacts is shown. Understandingly, more second grounding contacts can be disposed. For each group, a unitary grounding bar 130 is attached to the housing 110 and includes a pair lower spring fingers 132 respectively contacting lower regions of the contacting sections 122 of the ground contacts 120G in the transverse direction, and a pair of upper spring fingers 134 respectively contacting upper regions of the contacting sections 122 of the ground contacts 120G in the transverse direction. An upper transverse bar 136 is optionally linked between the pair of upper spring fingers 134 along the longitudinal direction. A lower transverse bar 138 is optionally linked between the pair of lower spring fingers 132 along the longitudinal direction. The pair of upper spring fingers 134 extends upwardly from the lower transverse bar 138. A transverse base 140, from which the pair of lower spring fingers 132 upwardly extends, having a retaining device 142 thereof is attached to a lower portion of the housing 110 wherein the transverse bases 140 of the adjacent two groups are joined together for sharing the same retaining device 142 thereof. Understandably, both lower transverse bar 138 and the upper transverse bar 136 may be eliminated in simplified embodiment to have the pair upper spring fingers 134 directly upwardly extending from the transverse base 140. Anyhow, the performance of the grounding bar of the simplified embodiment is interior to the first embodiment because the latter forms a plurality of loop paths. Notably, in this embodiment, the lower transverse bars 138 of the adjacent two groups are unified together to enhance the effect. Similarly, the upper transverse bars 136 of the two neighboring groups can be joined together to form a so-called closed type compared with the open type without linking therebetween.

Each elongate wall 113*a*/113*b* is provided with one unitary grounding bar 130. The widener transverse base 140 in the vertical direction is attached to the outside of the elongate wall 113*a*/113*b*, the lower spring fingers 132 extends slantwise from an upper edge of the transverse base 140, the lower spring fingers 132 contact all the grounding contacts including the first grounding contact 120G and the second grounding contacts 120*g* respectively, the upper spring fingers 136 only contact the first grounding contacts 120G which are located opposite sides of the pair of differential pair signals 120S, and do not extend and contact the second grounding contact 120*g*. The transverse base 140 is retained the insulative housing 110, the lower spring fingers 132 extend from the transverse base 140. The retaining device 142 in a tip fashion extend from the transverse base 140 and attached to the insulative housing. Two lower spring fingers 138 at opposite sides of each pair of differential-pair contacts 120S are linked with the lower transverse bar 138 along the longitudinal direction. Two upper spring fingers 134 at opposite sides of each pair of differential-pair contacts 120S extend from the lower transverse bar 138 and are linked with the upper transverse bar 136 along the longitudinal direction. The adjacent upper transverse bars 136 are separated from each other. Some lower transverse bars 138 extend along the longitudinal direction and connect with the next lower transverse bar 138 or next other grounding contact 120*g*. Some adjacent lower transverse bars 138 are separated from each other and the retaining device 142 is located between the adjacent lower transverse bar 138, while some adjacent lower transverse bars are connected with each other. In the embodiment, the upper spring finger 134 has an offset section (not labeled) to avoid interfering with the corresponding lower spring finger 132 which essentially extends upwardly in a straight manner from the transverse bar 140.

Figure 5:
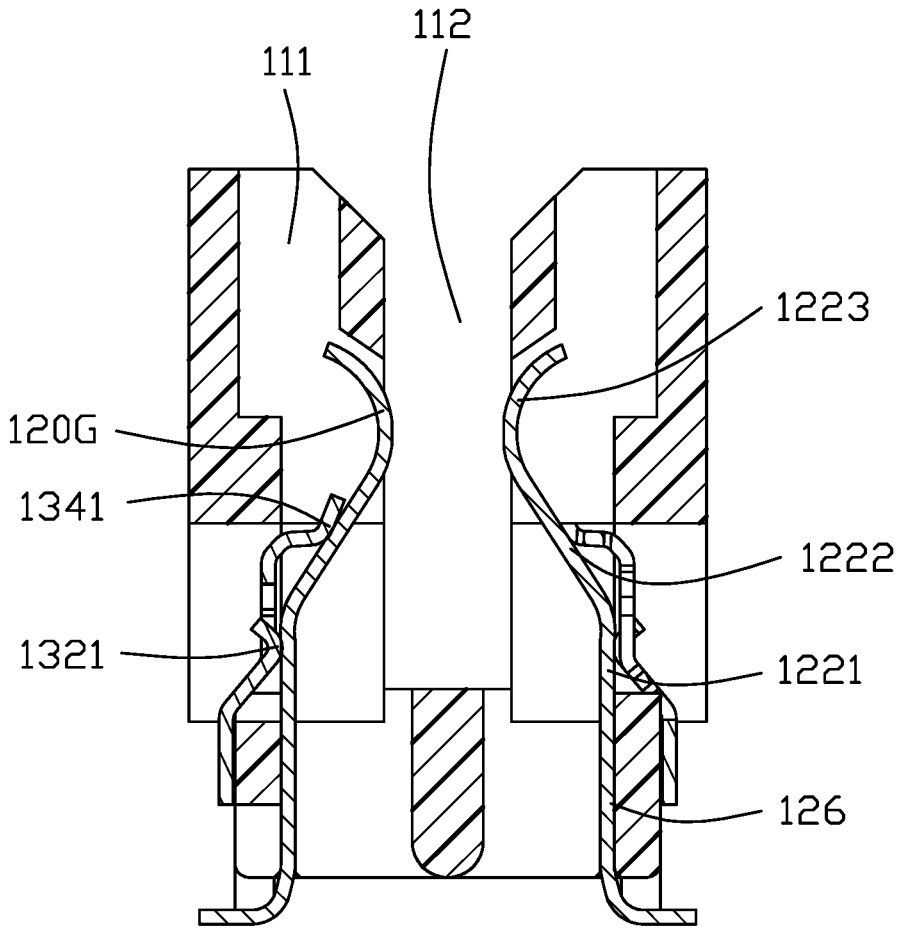
FIG. 5 is a cross-sectional view of the electrical connector of FIG. 1.
Figure 6:
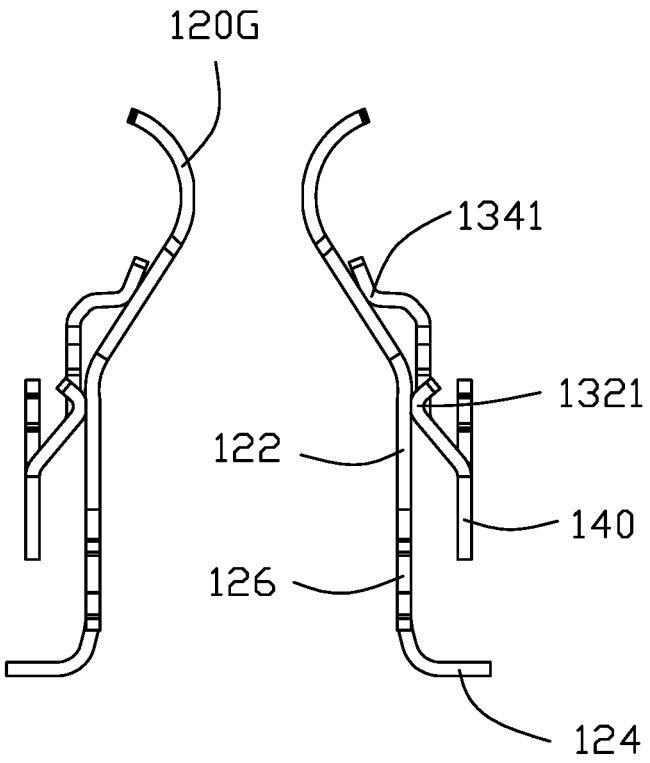
FIG. 6 is a side view of the grounding bars and the corresponding grounding contacts of the electrical connector of FIG. 1.
Figure 7:
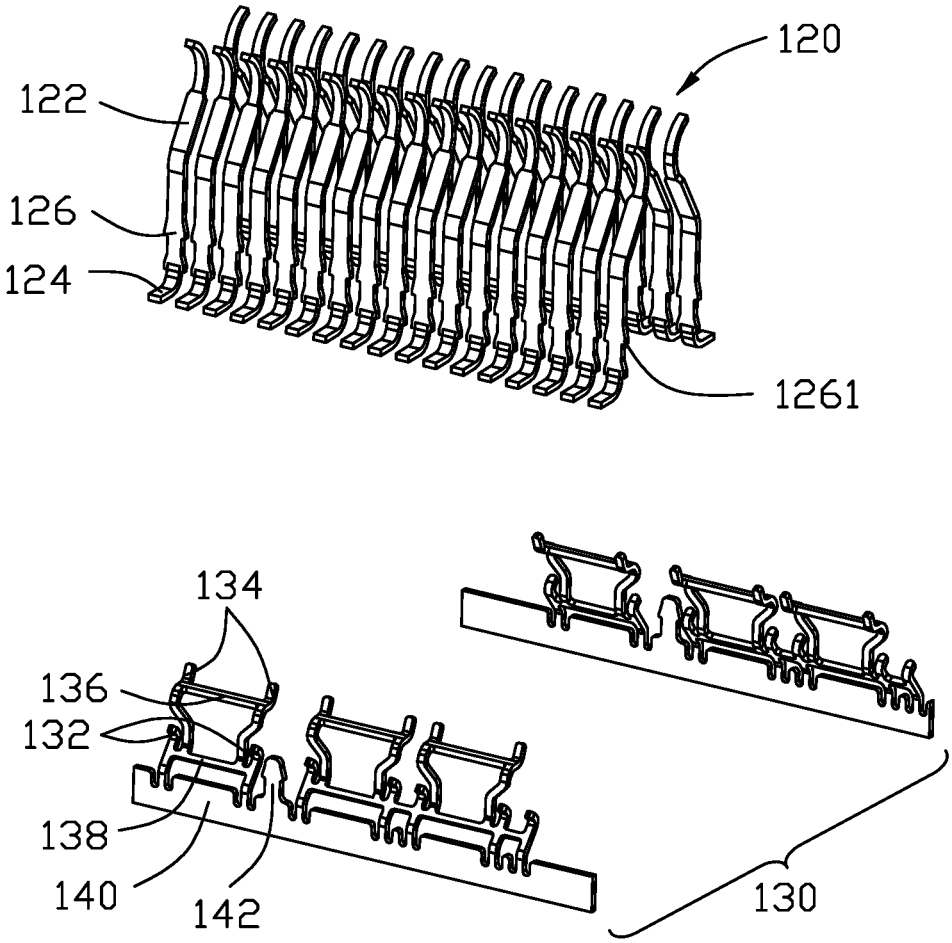
FIG. 7 is a further exploded perspective view of the electrical connector of FIG. 4(B)
Figure 8:
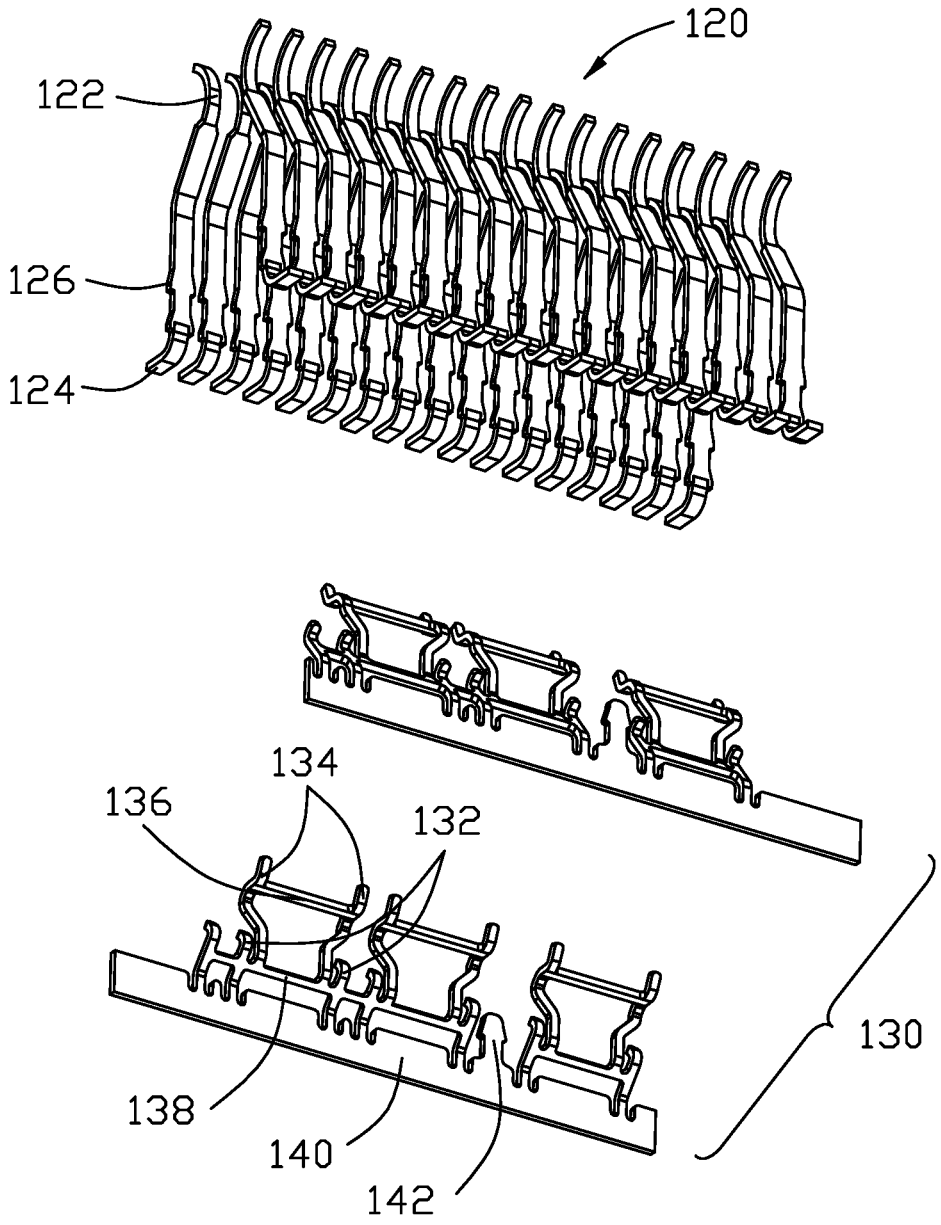
FIG. 8 is a further exploded view of the electrical connector of FIG. 4(A)
Figure 9:
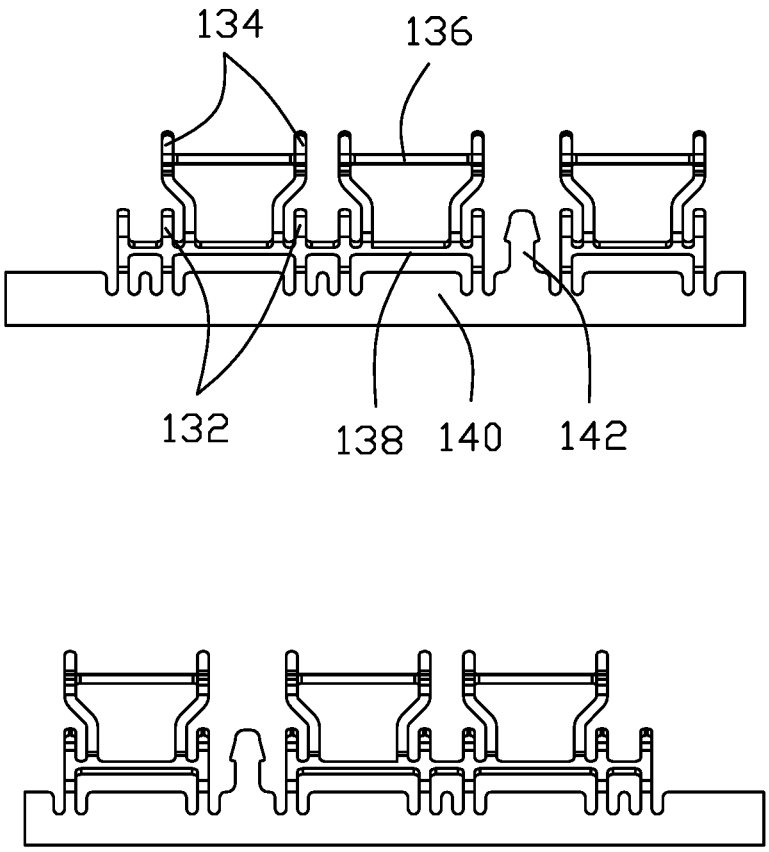
FIG. 9 is a side view of the grounding barbs of electrical connector FIG. 6.

Referring to FIGS. 5 and 7, each contact 120 has the resilient section 122, tail section 124 and retaining section 126. The retaining section 126 is provided with lateral projecting bars 1261 and retained in the passageway 111. The resilient section 122 includes an upright portion 1221 extending from the retaining section 126 and exposing upon the passageway 111, a slanting portion 1222 across the passageway 111 and an arc contacting portion 1223 exposing upon the receiving slot 112. The upright portion 1221 and the slating portion 1222 offer resilient force. The upper spring fingers 134 and the lower spring fingers 134 defined contacting points 1341, 1321, which are used to touch the grounding contacts. The lower contacting points 1321 contact the upright portion 1221, the upper contacting points 1341 contact the slanting portion 1222. The upper transverse bar 136 and the lower transverse bar 138 are joint below but near corresponding contacting points 1341, 1321.

It has an air channel above the ground terminal and solid plastic surrounds the signal terminals in an edge coupled connector lead frame. Air channels/pockets 115 have been used between signal terminals and signal and ground terminals to tune impedance, reduce the electrical length of a connector, or in ratios to dampen resonances. This invention uses solid plastic around the signal terminals with air channels above the ground terminals to dampen resonances. The ground bar contacts the resilient section rather than the stationary retaining section may further mechanically enhance the engagement between the resilient section and the inserted module advantageously in addition to the electrical benefit. In addition, the elongate wall 113 of the housing is intentionally remove to expose the passageways and the corresponding contacts in the transverse direction to the exterior so as to improve impedance thereof.

Figure 2A:
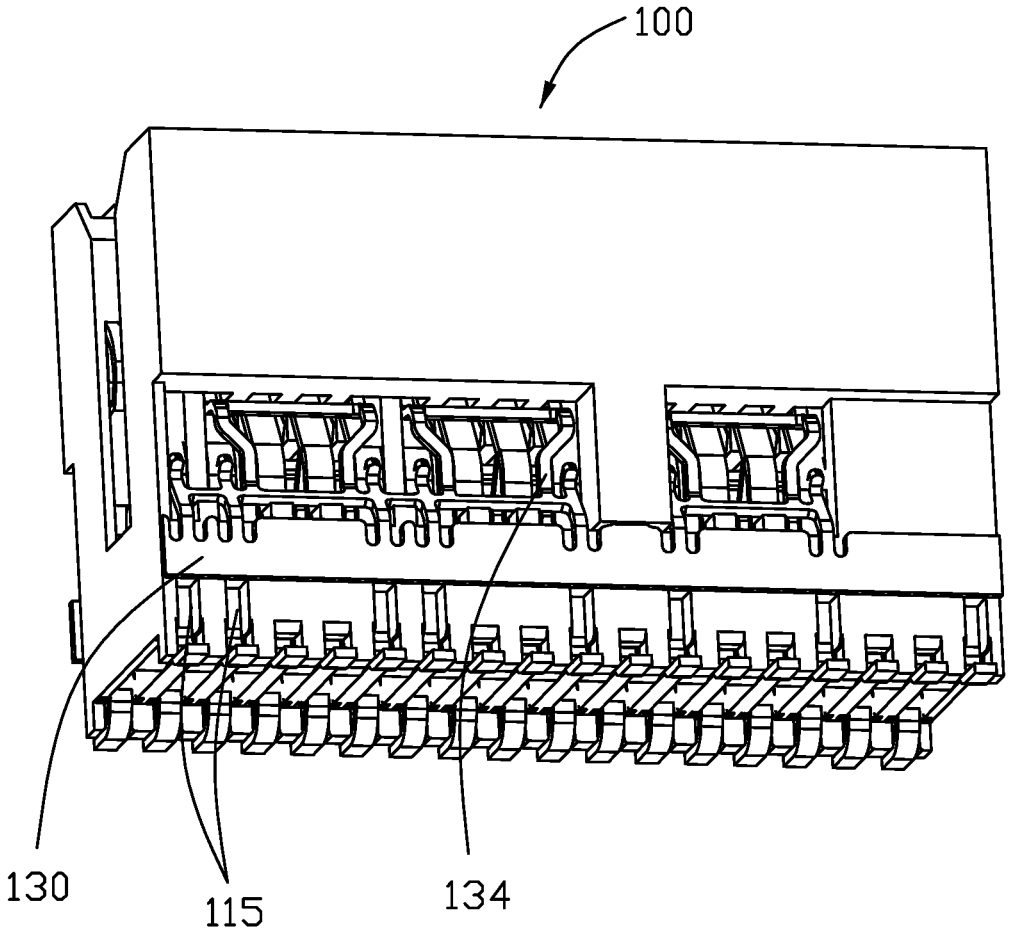
FIG. 2(A) is another perspective view of the electrical connector of FIG. 1.
Figure 2B:
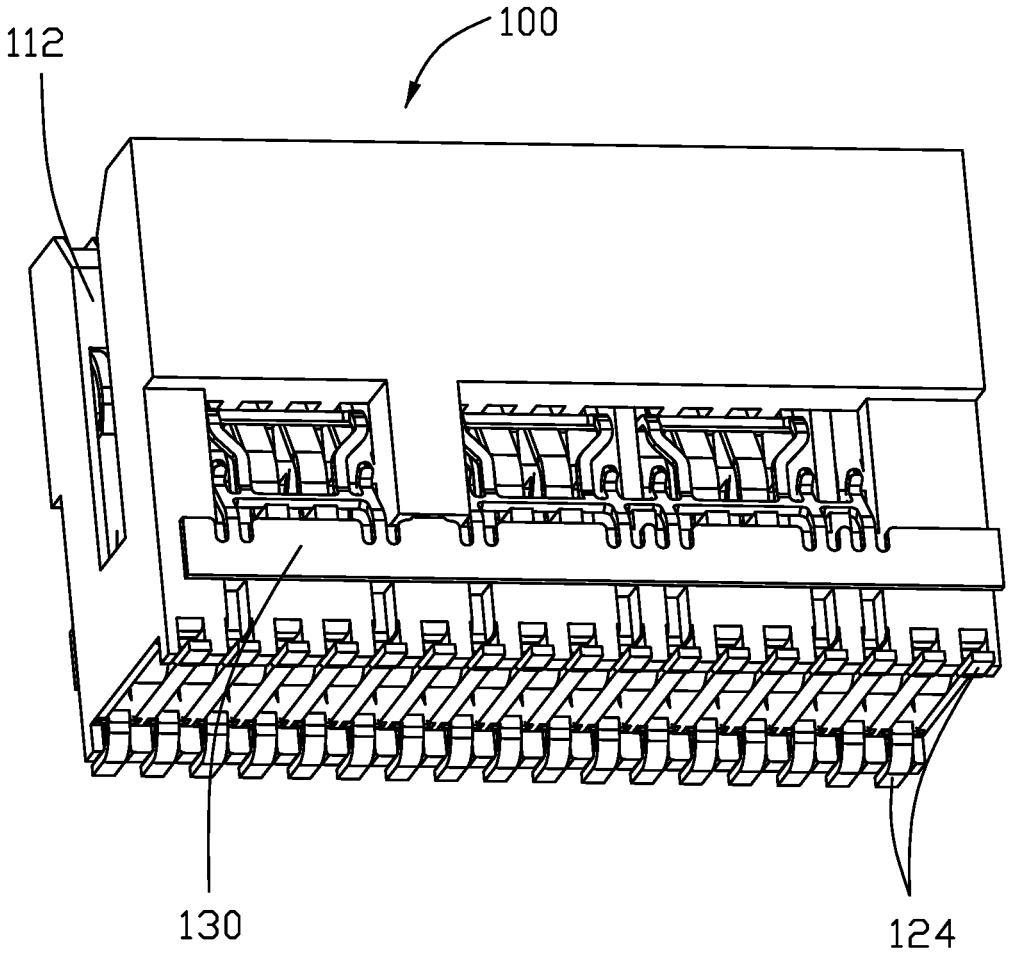
FIG. 2(B) is another perspective view of the electrical connector of FIG. 1 opposite to FIG. 2.
Figure 3A:
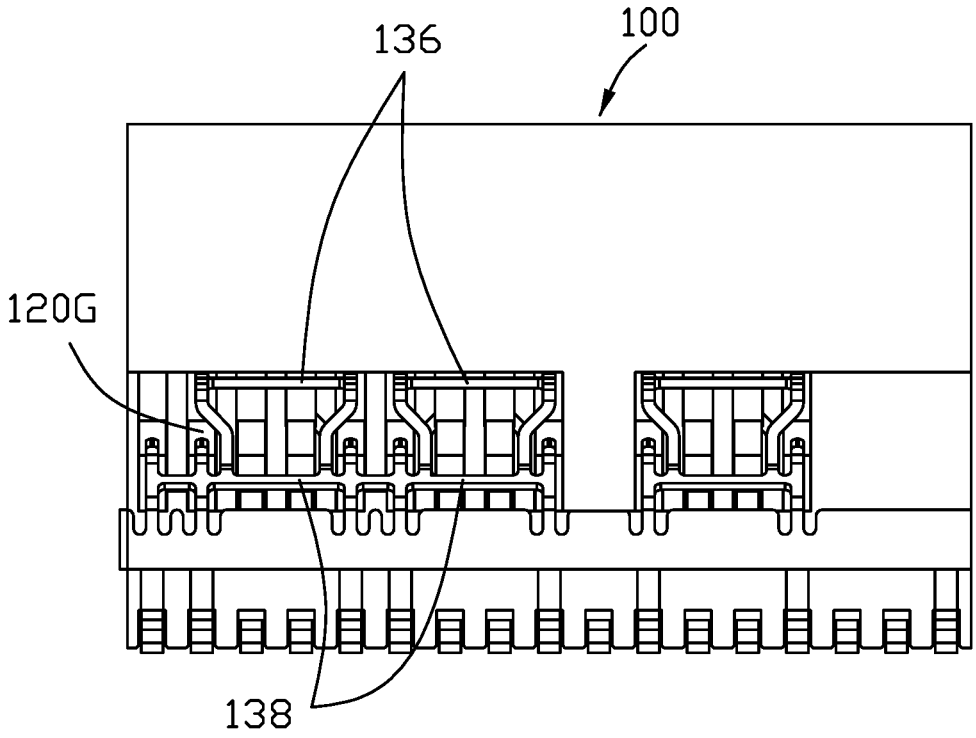
FIG. 3(A) is a side view of the electrical connector of FIG. 2(A)
Figure 3B:
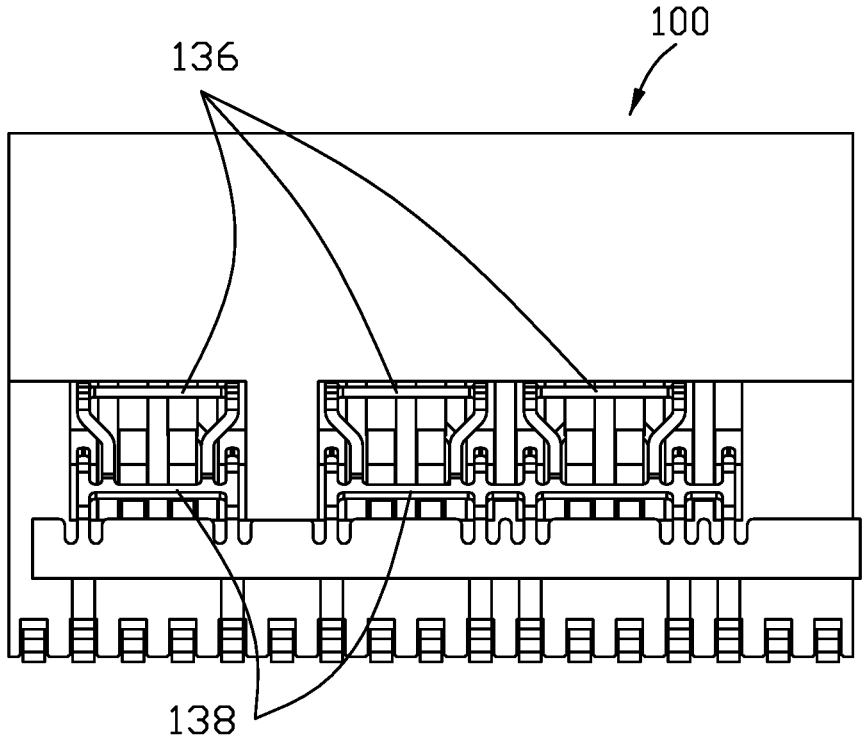
FIG. 3(B) is another side view of the electrical connector of FIG. 2(B)
Figure 4A:
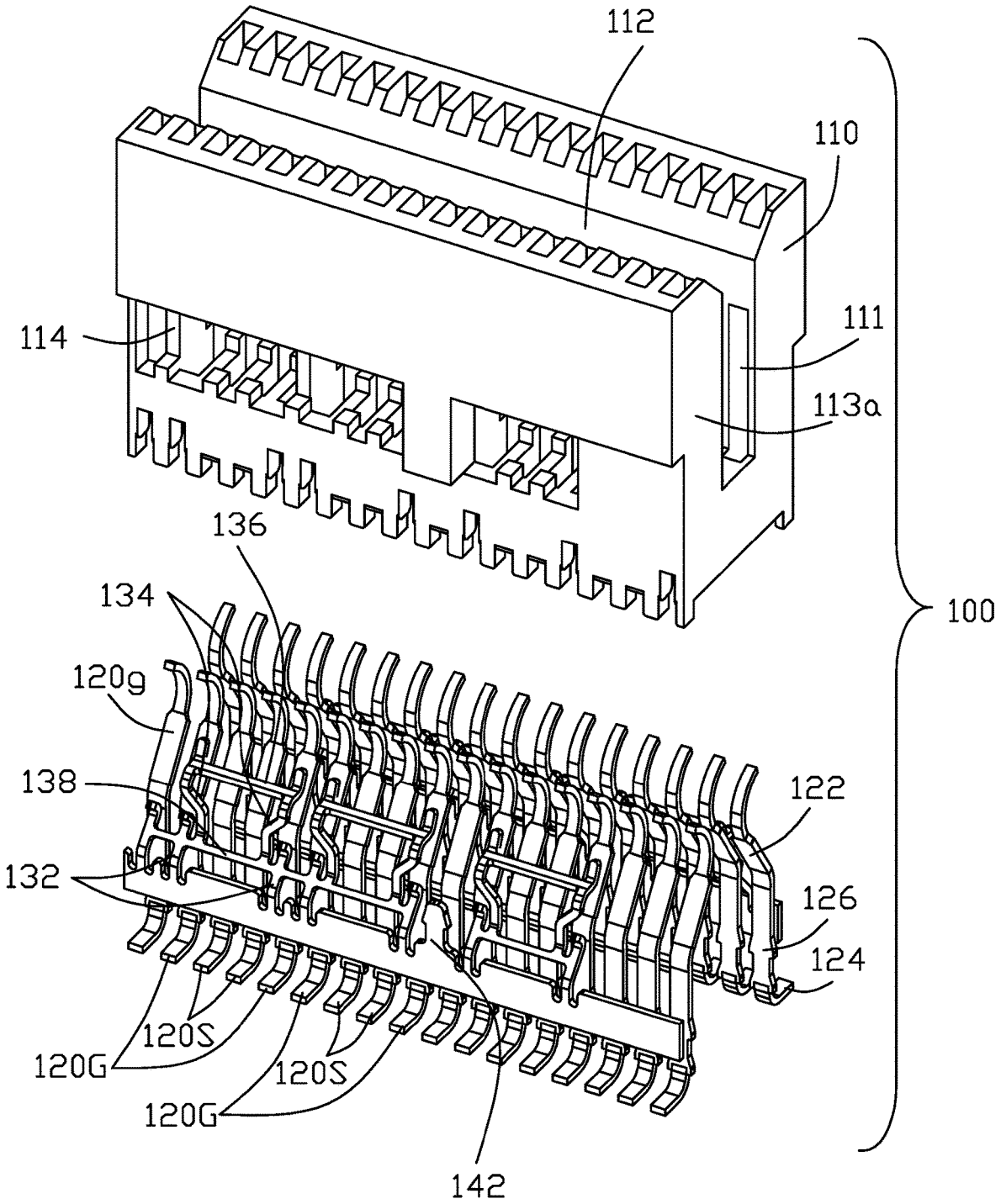
FIG. 4(A) is an exploded perspective view of the electrical connector of FIG. 1 wherein the grounding bar contacts the corresponding contacts.
Figure 4B:
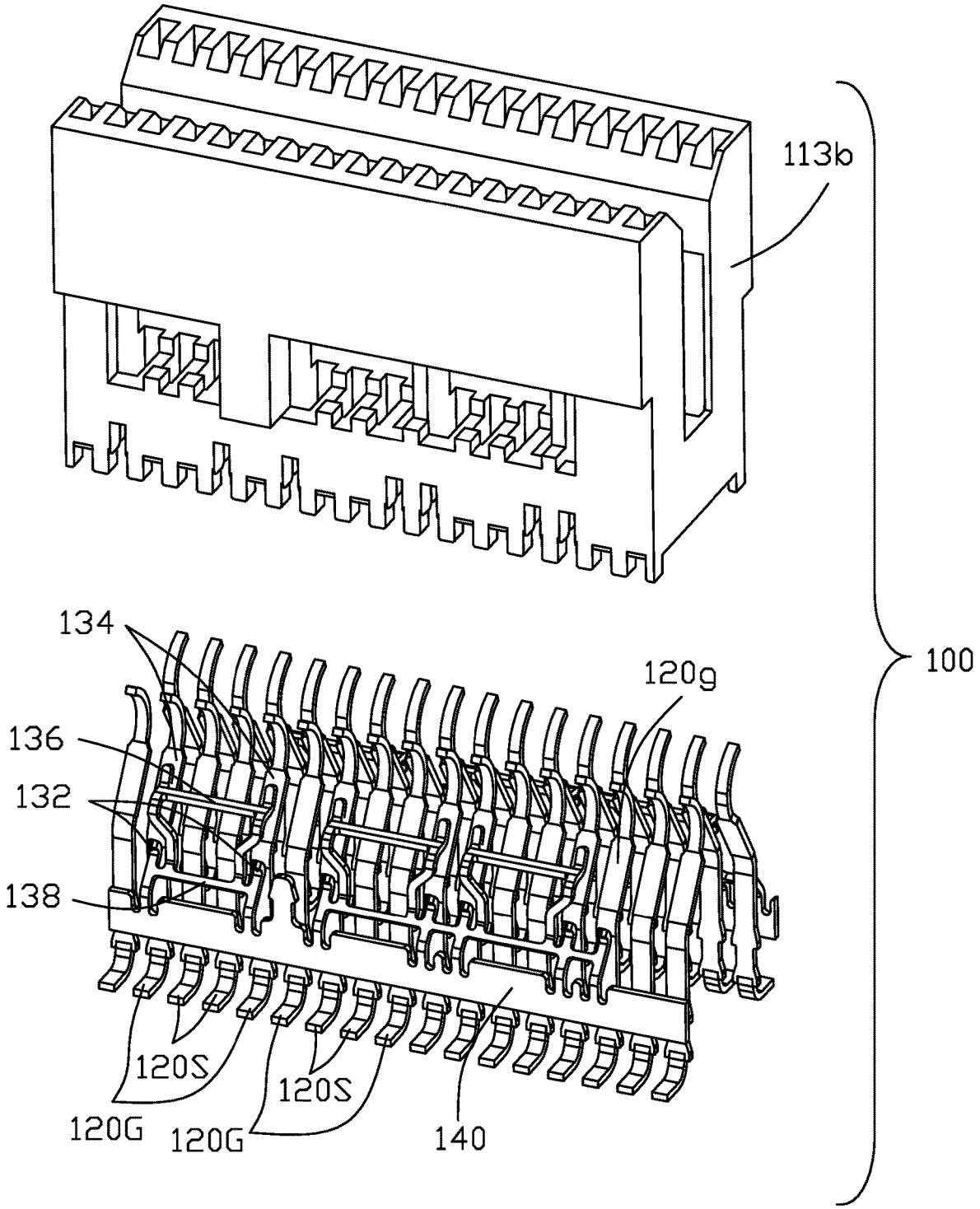
FIG. 4(B) is another exploded perspective view of the electrical connector of FIG. 4(A)

In this embodiment, the elongate wall 113 defines windows 114, parts of the upright portion 1221 and slanting portions 1222 are exposed upon the windows 114 and the upper and lower spring finger slant inwards and touch the grounding contacts, The roots of the upper spring fingers 134 are located in between corresponding lower spring fingers 132. Channels 115 are provided in the elongate wall 113 to expose lower portions of the retaining section 126 of the contacts. Please note, the channels 115 for grounding contacts are longer in the vertical direction than the channels for signal contacts as best shown in FIG. 2(A).

However, the disclosure is illustrative only, changes may be made in detail, especially in matter of shape, size, and arrangement of parts within the principles of the invention.

What is claimed is:

1. An electrical connector comprising:

an insulative housing comprising two opposite elongate walls and an elongate slot between the two elongate walls;

a plurality of contacts located in each elongate wall of the housing and having grounding contacts and differential-pair contacts; and a unitary grounding bar attached to each elongate wall of the housing, wherein the grounding bar comprises:

a pair of lower spring fingers respectively contacting lower regions of the ground contacts in a transverse direction, and a pair of upper spring fingers respectively contacting upper regions of the ground contacts in the transverse direction;

an upper transverse bar linked between the pair of upper spring fingers along a longitudinal direction;

a lower transverse bar linked between the pair of lower spring fingers along the longitudinal direction, the pair of upper spring fingers extend upwardly from the lower transverse bar; and a transverse base having retaining device attached to a lower portion of the housing, and the pair of lower spring fingers upwardly extend from the transverse base.

2. The electrical connector as claimed in claim 1, wherein the contacts comprise retaining sections retained in the housing, upper resilient sections extending upwardly from the retaining sections with contacting portion extending into the receiving slot, and lower tail sections extending from the retaining section, the lower spring fingers contact lower regions of the resilient sections of the grounding contacts and the upper spring fingers contact upper regions of the resilient sections.

3. The electrical connector as claimed in claim 1, wherein the grounding contacts are categorized with pairs of first grounding contacts located at two opposite sides of each pair of differential-pair signal contacts and second grounding contacts, the pair of lower spring fingers and the pair of lower spring fingers contact a same pair of first grounding contacts.

4. The electrical connector as claimed in claim 1, wherein the grounding contacts are categorized with pairs of first grounding contacts located at two opposite sides of each pair of differential-pair signal contacts and second grounding contacts, the pair of lower spring fingers and the pair of lower spring fingers contact a same pair of first grounding contacts.

5. The electrical connector as claimed in claim 4, wherein the grounding bar further comprises at least one lower spring fingers extending from the transverse base and contact a lower portion of the second grounding contact while there are no upper spring fingers provided for contacting the second grounding contacts.

6. An electrical connector comprising: an insulative housing comprising two opposite elongate walls along a longitudinal direction, and an elongate slot between the two elongate walls in a lateral direction perpendicular to the longitudinal direction; a plurality of contacts located in each elongate wall of the housing and having pairs of differential-pair contacts, pairs of grounding contacts located at two opposite sides of each pair of differential-pair contacts; and a unitary grounding bar attached to each elongate wall of the housing; wherein the grounding bar comprises a plurality of lower spring fingers and a plurality of upper spring fingers, wherein in a vertical direction perpendicular to both the longitudinal direction and the lateral direction, the lower spring fingers contact lower portions of the grounding contact, respectively, while the upper spring fingers contact upper portions of the grounding contacts respectively, wherein two lower spring fingers at opposite sides of each pair of differential-pair contacts are linked with a lower transverse bar along the longitudinal direction, wherein two upper spring fingers at opposite sides of each pair of differential-pair contacts are linked with an upper transverse bar along the longitudinal direction, wherein the upper spring fingers extend from corresponding lower transverse bar.

7. The electrical connector as claimed in claim 6, wherein an additional grounding contact is located beside the pair of grounding contacts, and one of the plurality of lower spring fingers contacts said additional grounding contact while none of the upper spring fingers contact said additional grounding contact.

8. The electrical connector as claimed in claim 6, wherein the grounding bar comprises a transverse base retained the insulative housing, and the lower spring fingers extend from the transverse base and at least one retaining device extends from the transverse base and attached to the insulative housing.

9. The electrical connector as claimed in claim 6, wherein the upper spring fingers and the lower spring fingers define contacting points which are used to touch the grounding contacts, and the upper transverse bar and the lower transverse bar are joined below near corresponding contacting points.

10. The electrical connector as claimed in claim 6, wherein the grounding bar comprises a transverse base equipped with a retaining device retained to the housing, and the lower spring fingers directly extend upwardly from the transverse base.

11. The electrical connector as claimed in claim 10, wherein the upper spring fingers indirectly extend from the transverse base via corresponding lower transverse bars connected to the corresponding lower spring fingers in at least the longitudinal direction.

12. The electrical connector as claimed in claim 6, wherein in a side view, the upper spring fingers are of an offset arrangement to avoid interfering with the corresponding lower spring finger adjacent thereto.

13. The electrical connector as claimed in claim 6, wherein the lower spring fingers and the upper spring fingers contact the corresponding grounding contacts in the lateral direction.

14. The electrical connector as claimed in claim 6, wherein the contact point of the upper spring finger is located at an inner side of that of the lower spring finger in the lateral direction.

15. An electrical connector comprising:

an insulative housing including a pair of side walls extending along a longitudinal direction, and a receiving slot located between the pair of side walls in a lateral direction perpendicular to the longitudinal direction;

a plurality of contacts retained in the housing and having grounding contacts and differential-pair contacts; and a unitary grounding bar attached to the housing and including:

a pair lower spring fingers respectively contacting lower regions of contacting sections of the ground contacts in said lateral direction, and a pair of upper spring fingers respectively contacting upper regions of the contacting sections of the ground contacts in the lateral direction whereby each grounding contact has two contact points with the grounding bar; and a transverse base extending along the longitudinal direction and equipped with a retaining device to retain the grounding bar to the housing; wherein the lower spring fingers directly extend upwardly from the transverse base while the upper spring fingers indirectly extend from the transverse base via a lower transverse bar linked to at least one corresponding lower spring finger and extending in at least along said longitudinal direction.

16. The electrical connector as claimed in claim 15, wherein the lower transverse bar extends between the pair of lower spring fingers in the longitudinal direction.

17. The electrical connector as claimed in claim 15, wherein the upper spring finger defines an offset configuration to avoid interfering with the corresponding lower spring finger adjacent thereto.

* * * * *